US010822897B2

(12) United States Patent
Hrupp

(10) Patent No.: US 10,822,897 B2
(45) Date of Patent: Nov. 3, 2020

(54) MODULAR FORCE MULTIPLIER FOR DOWNHOLE TOOLS

(71) Applicant: Joze John Hrupp, Montgomery, TX (US)

(72) Inventor: Joze John Hrupp, Montgomery, TX (US)

(73) Assignee: EXACTA-FRAC ENERGY SERVICES, INC., Conroe, TX (US)

( * ) Notice: Subject to any disclaimer, the term of this patent is extended or adjusted under 35 U.S.C. 154(b) by 210 days.

(21) Appl. No.: 15/980,992

(22) Filed: May 16, 2018

(65) Prior Publication Data

US 2019/0352987 A1 Nov. 21, 2019

(51) Int. Cl.

| | |
|---|---|
| ***E21B 23/00*** | (2006.01) |
| ***E21B 23/04*** | (2006.01) |
| ***E21B 23/06*** | (2006.01) |

(52) U.S. Cl.

CPC ..... *E21B 23/00* (2013.01); *E21B 23/04* (2013.01); *E21B 23/06* (2013.01)

(58) Field of Classification Search

CPC ..... E21B 23/00; E21B 23/06; E21B 23/04
See application file for complete search history.

(56) References Cited

U.S. PATENT DOCUMENTS

| | | | |
|---|---|---|---|
| 2,769,497 | A | 11/1956 | Reistle, Jr. |
| 2,927,638 | A | 3/1960 | Hall, Sr. |
| 3,090,436 | A | 5/1963 | Briggs, Jr. |
| 3,160,209 | A | 12/1964 | Bonner |
| 4,487,258 | A | 12/1984 | Jackson et al. |
| 5,152,340 | A | 10/1992 | Clark et al. |
| 5,383,520 | A | 1/1995 | Tucker et al. |
| 5,803,177 | A | 9/1998 | Hriscu et al. |
| 5,810,082 | A | 9/1998 | Jordan et al. |
| 5,890,540 | A | 4/1999 | Pia et al. |
| 5,904,207 | A | 5/1999 | Rubio et al. |
| 6,253,856 | B1 | 7/2001 | Ingram et al. |
| 6,484,805 | B1 | 11/2002 | Perkins et al. |
| 6,564,876 | B2 | 5/2003 | Vaynshteyn |
| 6,776,239 | B2 | 8/2004 | Elsinger et al. |
| 6,832,654 | B2 | 12/2004 | Ravensburger et al. |
| 7,341,111 | B2 | 3/2008 | Van et al. |
| 7,377,834 | B2 | 3/2008 | Surjaatrnadja et al. |
| 7,500,526 | B2 | 3/2009 | Telfer |
| 7,789,163 | B2 | 9/2010 | Kratachvil et al. |
| 8,201,631 | B2 | 6/2012 | Stromquist et al. |
| 8,336,615 | B2 | 12/2012 | Hughes et al. |
| 8,490,702 | B2 | 7/2013 | Stromquist et al. |
| 9,016,390 | B2 | 4/2015 | Stewart et al. |
| 9,334,714 | B2 | 5/2016 | Stromquist et al. |
| 9,580,990 | B2 | 2/2017 | Flores et al. |
| 9,598,939 | B2 | 3/2017 | Lee |
| 9,631,456 | B2 * | 4/2017 | Vick, Jr. ..... E21B 34/10 |
| 10,066,466 | B2 * | 9/2018 | Radtke ..... E21B 43/105 |
| 2005/0077053 | A1 | 4/2005 | Walker et al. |
| 2007/0034370 | A1 | 2/2007 | Moyes |

(Continued)

*Primary Examiner* — Giovanna Wright
*Assistant Examiner* — Jonathan Malikasim
(74) *Attorney, Agent, or Firm* — J. Bennett Mullinax LLC

(57) ABSTRACT

A modular force multiplier converts a pull-up force applied to a work string from the surface into a multiplied opposite linear force that can be used to operate downhole tools to perform tasks requiring the application of linear force.

20 Claims, 4 Drawing Sheets

(56) References Cited

U.S. PATENT DOCUMENTS

| | | | | |
|---|---|---|---|---|
| 2015/0211333 | A1* | 7/2015 | Vick, Jr. ..... | E21B 34/066<br>166/375 |
| 2015/0376979 | A1 | 12/2015 | Mitchell et al. | |
| 2016/0369585 | A1 | 12/2016 | Limb et al. | |

* cited by examiner

MODULAR FORCE MULTIPLIER FOR DOWNHOLE TOOLS

CROSS REFERENCE TO RELATED APPLICATIONS

This is the first application for this invention.

FIELD OF THE INVENTION

This invention relates in general to tools for performing downhole operations that require an application of mechanical force and, in particular, to a novel modular force multiplier for generating mechanical force in downhole tools on an as required basis.

BACKGROUND OF THE INVENTION

Various arrangements for providing mechanical force to perform operations with downhole tools for accomplishing certain downhole tasks are known. For example, piston assemblies for converting pumped fluid pressure to mechanical force in a downhole tool are used in downhole tools such as packers, straddle packers, tubing perforators and the like. Such piston assemblies employ a plurality of pistons connected in series to an inner or outer mandrel of a downhole tool to increase the force that can be generated from a given pressure of fluid pumped down through a work string to the downhole tool. An example of one such piston assembly can be found in U.S. Pat. No. 8,336,615 which issued on Dec. 25, 2012. While such piston assemblies have proven useful, a different means of downhole force multiplication is desirable.

There therefore exists a need for a modular force multiplier for downhole tools.

SUMMARY OF THE INVENTION

It is therefore an object of the invention to provide a modular force multiplier for downhole tools.

The invention therefore provides a force multiplier module, comprising: a small piston sleeve connected on one end to a sleeve connector, the small piston sleeve having at least one fluid port therethrough adjacent the sleeve connector, a large piston sleeve connected to an opposite end of the small piston sleeve, the large piston sleeve having at least one fluid port adjacent a central passage; a large piston mandrel that extends through the central passage in the large piston sleeve and a central passage in the sleeve connector; a large piston on the large piston mandrel; a small piston adapted to reciprocate on the large piston mandrel between the sleeve connector and the large piston sleeve; and an energizing cylinder sleeve that surrounds the sleeve connector and the small cylinder sleeve and defines an energizing fluid chamber surrounding the small cylinder sleeve.

The invention further provides a modular force multiplier, comprising: a work string connection sub; and at least one force multiplier module connected to the work string connection sub, the at least one force multiplier module comprising: a sleeve connector connected to the work string connection sub; a small piston sleeve connected on one end to the sleeve connector; a large piston sleeve connected to an opposite end of the small piston sleeve; a large piston adapted to reciprocate in a large piston chamber of the large piston sleeve, the large piston having a large piston mandrel that extends through central passages in the large piston sleeve and the sleeve connector; a small piston adapted to reciprocate on the large piston mandrel between the sleeve connector and the large piston sleeve; and an energizing cylinder sleeve that surrounds the sleeve connector and the small cylinder sleeve and defines an energizing fluid chamber surrounding the small cylinder sleeve; whereby urging the energizing cylinder sleeve to slide over the small piston sleeve forces contained fluid through ports in the small cylinder sleeve to urge movement of the small piston, which forces contained fluid through ports in the large piston sleeve to urge corresponding movement of the large piston.

The invention yet further provides a modular force multiplier, comprising: a work string connection sub; a bumper mandrel connected to the work string connection sub, the bumper mandrel having a bumper mandrel socket end; a bumper mandrel stop sub that reciprocates on the bumper mandrel between the work string connection sub and the bumper mandrel socket end; a bumper mandrel sleeve connected to a lower end of the bumper mandrel stop sub, the bumper mandrel sleeve defining a bumper mandrel chamber in which the bumper mandrel socket end reciprocates; a sleeve connector connected to a lower end of the bumper mandrel sleeve; a small piston sleeve connected on one end to the sleeve connector; a large piston sleeve connected to an opposite end of the small piston sleeve; a large piston adapted to reciprocate in a large piston chamber of the large piston sleeve, the large piston having a large piston mandrel that extends through central passages in the large piston sleeve and the sleeve connector; a small piston adapted to reciprocate on the large piston mandrel between the sleeve connector and the large piston sleeve; an energizing selector sleeve that reciprocates on a lower end of the work string connection sub and surrounds the bumper mandrel sleeve; an energizing transition sleeve connected to a lower end of the energizing selector sleeve and surrounds the sleeve connector and the small cylinder sleeve, defining an energizing fluid chamber surrounding the small cylinder sleeve; whereby urging the energizing selector sleeve to slide the energizing transition sleeve over the small piston sleeve forces contained fluid through ports in the small cylinder sleeve to urge movement of the small piston, which forces contained fluid through ports in the large piston sleeve to urge corresponding movement of the large piston.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

Figure 1:
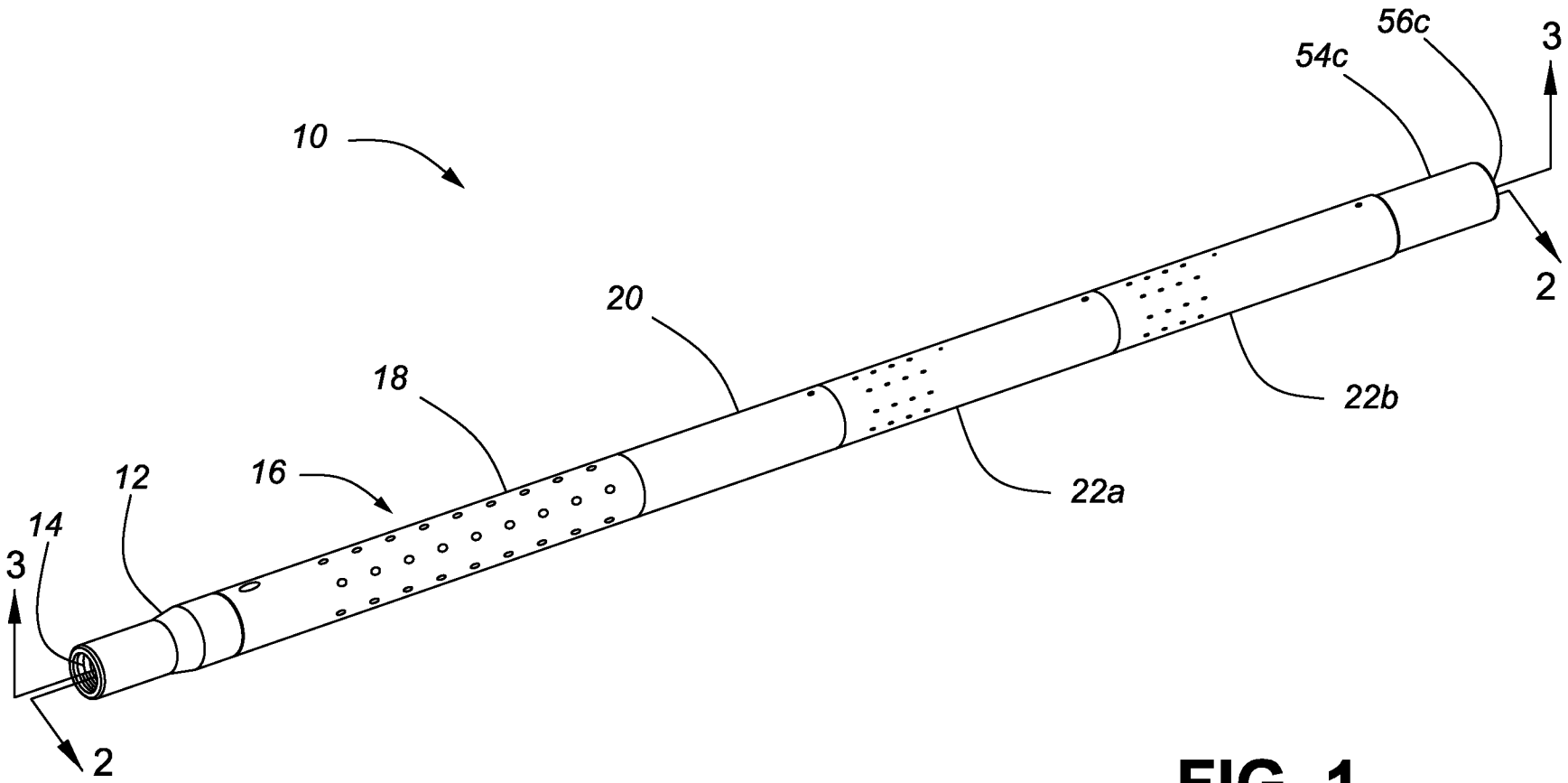
FIG. 1 is a perspective view of one embodiment of a modular force multiplier for a downhole tool in accordance with the invention.

The invention provides a modular force multiplier for downhole tools. The modular force multiplier is connected to a work string. The modular force multiplier converts a pull-up force applied form the surface to the work string into an opposite linear mechanical force that is multiplied during the force conversion. The multiplied linear mechanical force can be employed to perform an action using a downhole tool connected to the modular force multiplier. The downhole tool can be used to, by way of example only: set slips; set packers; perforate a casing or tubing; open or close a sliding sleeve; or, perform many other downhole tool functions, or combination of downhole tubing functions, requiring the application of linear mechanical force. Contained fluid is used to convert and multiply the pull-up force applied from the surface to the work string. Each module of the modular force multipliers includes a small piston that reciprocates in a small piston chamber over a piston rod of a large piston. The small piston urges a proportion of the contained fluid into a large piston chamber to drive the large piston, thus multiplying the applied force. The number of modules in the modular force multiplier determines the amount of force multiplication. The small pistons are driven by contained fluid forced into the small piston chambers by the pull-up force applied to the work string.

| Part No. | Part Description |
|---|---|
| 10 | Modular force multiplier |
| 12 | Work string connection sub |
| 14 | Work string connection |
| 16 | Multipart energizing sleeve |
| 18 | Energizing selector sleeve |
| 20 | Energizing transition sleeve |
| 21a-21c | Energizing fluid chamber |
| 22a, 22b | Energizing cylinder sleeves |
| 23a-23b | Energizing pressure equalization bores |
| 24 | Debris management bores |
| 25a-25c | Fluid seals |
| 26a-26g | Fill ports |
| 28a-28d | Bleed ports |
| 30 | Bumper mandrel |
| 32 | Bumper mandrel thread connection |
| 34 | Bumper mandrel stop sub |
| 36 | Bumper mandrel stop seal |
| 37 | Bumper mandrel chamber |
| 38 | Bumper mandrel sleeve |
| 39 | Bumper mandrel socket end |
| 40a-40c | Sleeve connectors |
| 42a-42c | Sleeve connector upper threads |
| 44a-44c | Sleeve connector lower threads |
| 46a-46c | Sleeve connector pressure seals |
| 48a-48c | Sleeve connector fluid seals |
| 50a-50c | Small piston sleeves |
| 51a-51c | Small piston chambers |
| 52a-52f | Small piston ports |
| 54a-54c | Large piston sleeves |
| 55a-55b | Large piston chamber |
| 56a-56c | Large piston sleeve thread |
| 58a-58f | Large piston sleeve ports |
| 60a-60c | Large piston mandrels |
| 61 | Multipart mandrel central passage |
| 62a-62c | Large pistons |
| 64a-64c | Large piston seals |
| 66a-66c | Large piston threads |
| 68a-68b | Large piston pressure equalization bores |
| 70a-70b | Large piston mandrel pressure equalization grooves |
| 72a-72b | Large piston mandrel pressure equalization bores |
| 74 | Debris management bores |
| 76a-76c | Small pistons |
| 78a-78c | Small piston outer seals |
| 80a-80c | Small piston inner seals |
| 82a-82c | Small piston fill bores |
| 84a-84c | Small piston fill plugs |
| 86a-86b | Energizing activation bores |
| 88a-88b | Energizing key mechanisms |
| 90a-90b | Energizing key springs |
| 92a-92b | Energizing key |
| 94a, 94b | Energizing key seals |
| 96a, 96b | Anti-rotation studs |
| 98a, 98b | Anti-rotation grooves |
| 100a, 100b | Energizing key retainer plates |

FIG. 1 is a perspective view of one embodiment of a modular force multiplier 10 in accordance with the invention. The modular force multiplier 10 is shown in a run-in condition for being run into a wellbore. The modular force multiplier 10 multiplies a pull-up force applied to a work string (not shown). The work string is connected to a work string connection sub 12 by a work string connection 14 at an uphole end of the modular force multiplier 10. The modular force multiplier 10 converts and multiplies the pull-up force to a linear mechanical force that can be utilized by a downhole tool (not shown) connected to a large piston sleeve thread 56*c* (see FIG. 2) of a large piston sleeve 54*c* at a downhole end of the modular force multiplier 10, as will be explained below in more detail with reference to FIGS. 3 and 4. In this embodiment, the modular force multiplier 10 includes a multipart energizing sleeve 16 that is selectively pulled from the run-in position to a multiplied force position shown in FIG. 4. The multipart energizing sleeve 16 includes an energizing selector sleeve 18. An energizing transition sleeve 20 is connected to a downhole end of the energizing selector sleeve 18. Connected to a downhole end of the energizing transition sleeve 20 is at least one energizing cylinder sleeve, in this embodiment there are two energizing cylinder sleeves 22*a* and 22*b*.

Figure 2:
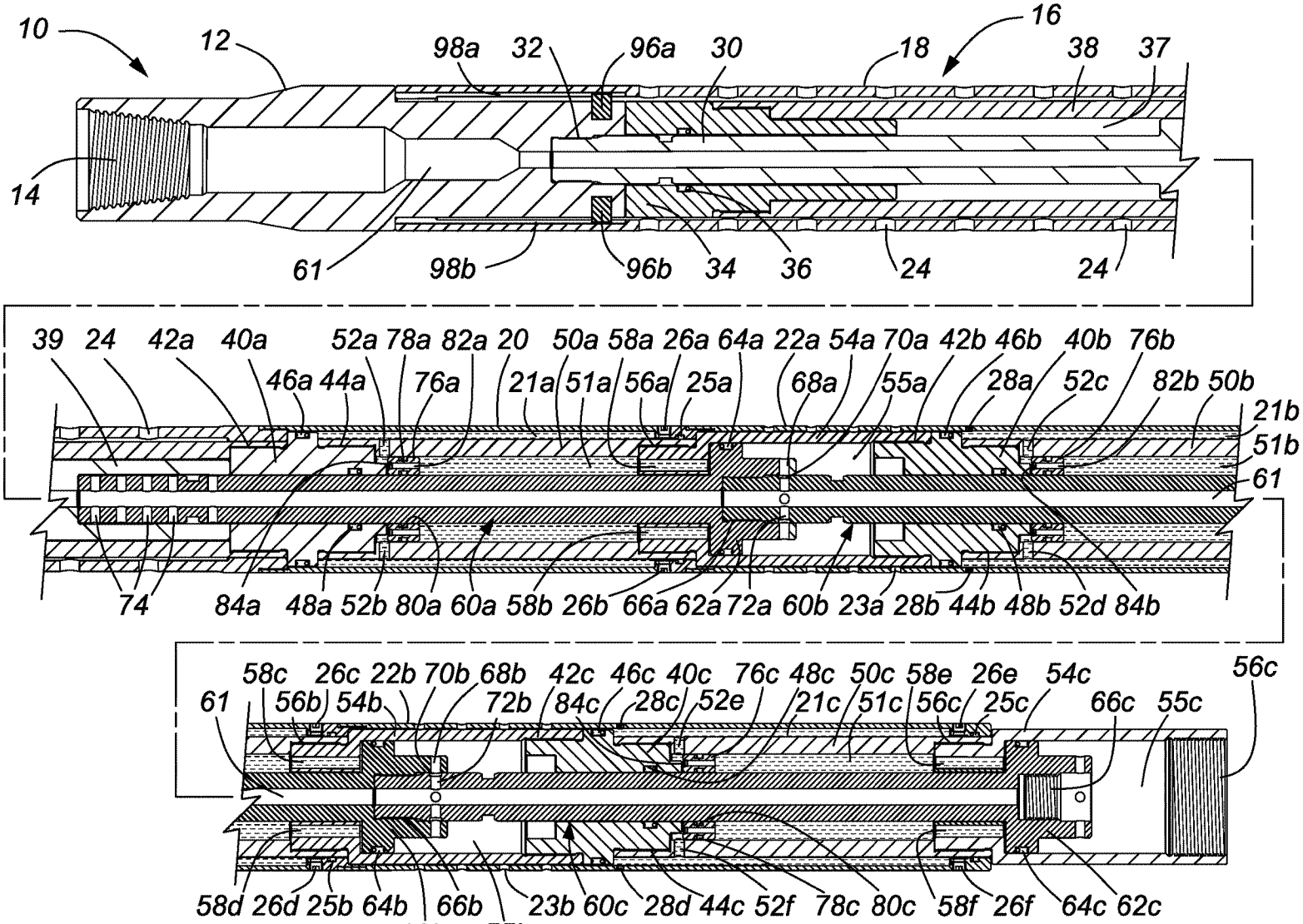
FIG. 2 is a cross-sectional view of the modular force multiplier taken along lines 2-2 shown in FIG. 1.

FIG. 2 is a cross-sectional view of the modular force multiplier 10 taken along lines 2-2 shown in FIG. 1. In this embodiment the work string connection 14 of the work string connection sub 12 is threaded for the connection of a jointed tubing work string, but the configuration of the work string connection 14 is a matter of design choice. The work string connection 14 may be configured for the connection of a coil tubing string, or any other type of work string capable of being used to apply the pull-up force to the modular force multiplier 10 when the modular force multiplier 10 is in a wellbore. As explained above, the multipart energizing sleeve 16 includes the energizing selector sleeve 18, which in this embodiment is provided with a plurality of debris management bores 24 in spaced distribution around the energizing selector sleeve 18 to ensure that wellbore debris does not accumulate within the energizing selector sleeve 18 as the force multiplier 10 is moved from the run-in position shown in FIGS. 1-3 to the multiplied force position shown in FIG. 4. Connected to the downhole end of the energizing selector sleeve 18 is the energizing transition sleeve 20, which defines a first annular energizing fluid chamber 21*a*, filled with a contained fluid (hydraulic oil, for example). A fluid seal 25*a* inhibits a migration of the contained fluid out of a downhole end of the energizing fluid chamber 21*a*, and a sleeve connector pressure seal 46*a* inhibits an egress of fluid from the uphole end of the energizing fluid chamber 21*a*. The energizing fluid chamber 21*a* is filled with contained fluid using fill ports 26*a*, 26*b*, one of which can be used as a fill port and the other of which can be used as a bleed port in a manner well known in the art. Alternatively, bleed ports (not shown) may also be provided.

Figure 3:
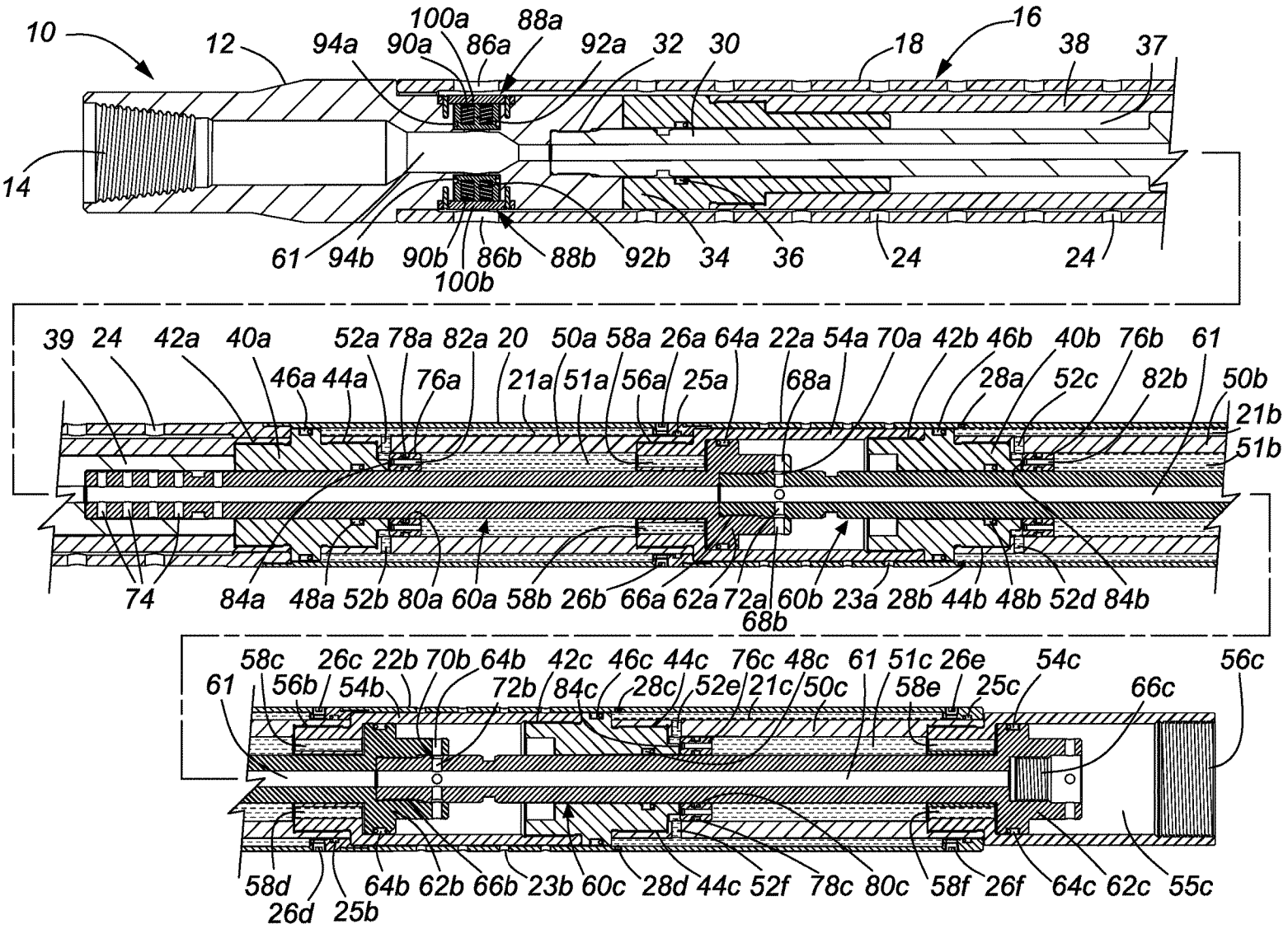
FIG. 3 is a cross-sectional view of the modular force multiplier taken along lines 3-3 shown in FIG. 1.
Figure 4:
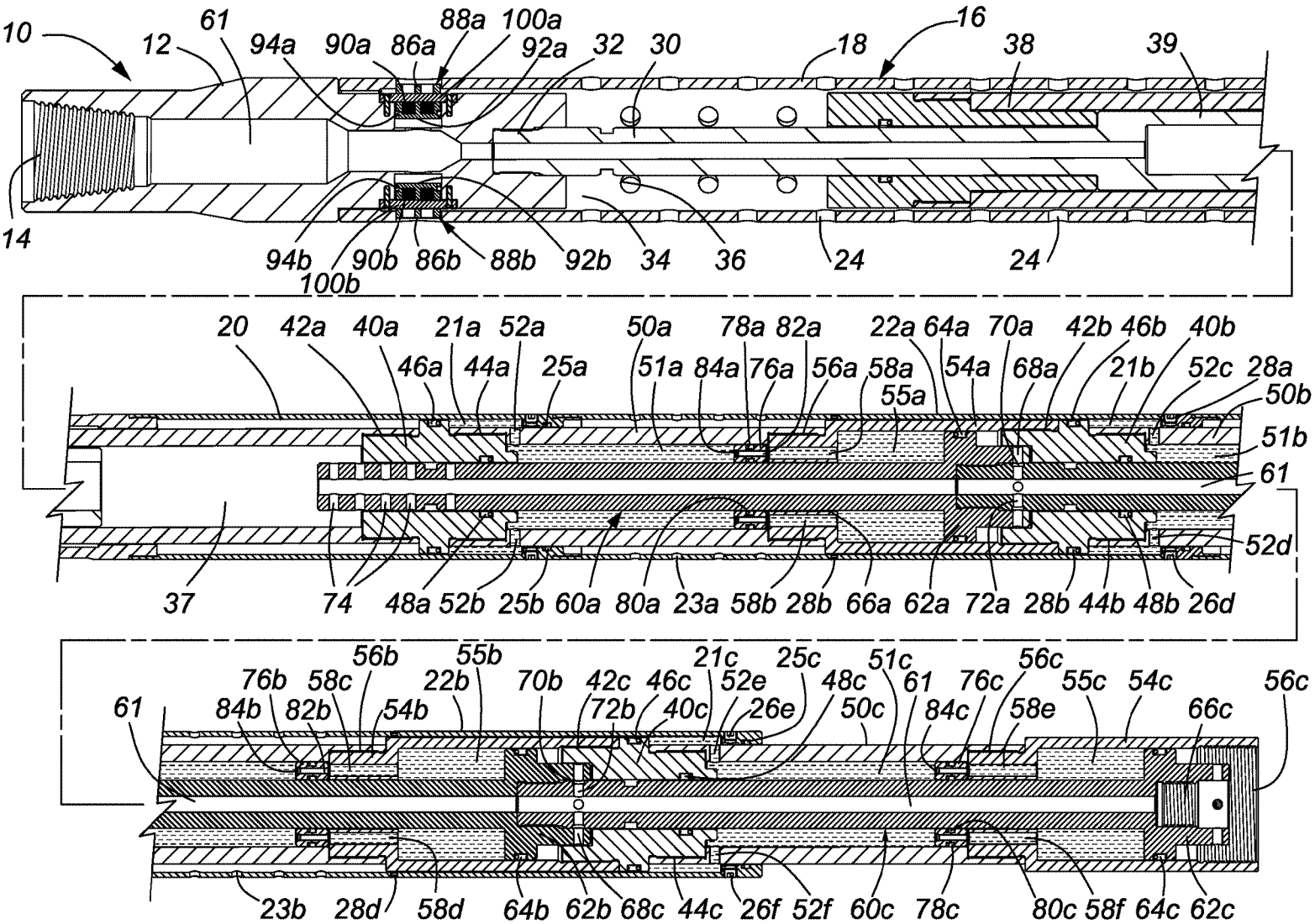
FIG. 4 is a cross-sectional view of the modular force multiplier taken along lines 3-3 shown in FIG. 1, subsequent to the multiplication of a pul-up force applied to a work string connected to the modular force multiplier.

Connected to a downhole, end of the energizing transition sleeve 21*a* is an energizing cylinder sleeve 22*a*, an uphole end of which is provided with a plurality of energizing pressure equalization bores 23*a* for pressure equalization and debris management behind the fluid seal 25*a* as the modular force multiplier 10 is shifted from the run-in position shown in FIGS. 1-3 to the force multiplied position shown in FIG. 4. A downhole end of the energizing cylinder sleeve 22*a* defines a second annular energizing fluid chamber 21*b* having fill ports 26*c* and 26*d* and bleed ports 28*a* and 28*b*. The energizing fluid chamber 21*b* may be filled with contained fluid, for example, using any of the fill ports 26*c*, 26*d* while air is bled from any one of the bleed ports 28*a*, 28*b*. A fluid seal 25*b* inhibits an egress of fluid from the lower end of the energizing fluid chamber 21*b* and a sleeve connector pressure seal 46*b* inhibits an egress of contained fluid from the upper end of the energizing fluid chamber 21*b*. In this embodiment, connected to a downhole end of the energizing cylinder sleeve 22*a* is another energizing cylinder sleeve 22*b*, an uphole end of which is provided with a plurality of energizing pressure equalization bores 23*b* for pressure equalization and debris management behind the fluid seal 25*b* as the modular force multiplier 10 is shifted from the run-in position to the multiplied force position. A downhole end of the energizing cylinder sleeve 22*b* defines a third annular energizing fluid chamber 21*c* having fill ports 26*e* and 26*f* and bleed ports 28*c* and 28*d*. The energizing fluid chamber 21*c* may be filled with contained fluid, for example, using any of the fluid fill ports 26*e*, 26*f* while air is bled from any one of the bleed ports 28*c*, 28*d*. A fluid seal 25*c* inhibits an ingress of contain fluid from a lower end of the energizing, fluid chamber 21*c*, and a sleeve connector pressure seal 46*c* inhibits an egress of fluid from the upper end of the energizing fluid chamber 21*c*.

A bumper mandrel 30 is threadedly connected to a downhole end of the work string connection sub 12 by a bumper mandrel thread connection 32. The bumper mandrel 30 is slidably received in a bumper mandrel stop sub 34 having a bumper mandrel stop seal 36 that inhibits ingress of well fluid into a central passage of the bumper mandrel stop sub 34. The bumper mandrel 30 has a bumper mandrel socket end 39 that receives an uphole end of a large piston mandrel 60*a* when the modular force multiplier 10 is in the run-in position. The bumper mandrel 30 is free to move back-and-forth within a bumper mandrel chamber 37 defined by a bumper mandrel sleeve 38 connected on an uphole end to the bumper mandrel stop sub 34 and on a downhole end to a sleeve connector upper thread 42*a* of a sleeve connector 40*a* having a central passage in with the large piston mandrel 60*a* reciprocates. As is well understood by those skilled in the art, lateral wellbores, especially long lateral wellbores, generally have a corkscrew shape. Consequently, tools being pushed into those bores may lurch as they are pushed through the corkscrew curves of the lateral wellbore. The bumper mandrel 30 cushions such lurching without engaging the force multiplication function of the modular force multiplier 10, which in this embodiment is engaged in a manner explained below with reference to FIG. 3.

The sleeve connector 40*a* has a sleeve connector lower thread 44*a* to which is connected a small piston sleeve 50*a* defining a small piston chamber 51*a*. Small piston ports 52*a*, 52*b* permit a passage of contained fluid from the energizing fluid chamber 21*a* into the small piston chamber 51*a* on a backside of a small piston 76*a*, and vice-versa. A downhole end of the small piston sleeve 50*a* is connected to a large piston sleeve thread 56*a* of a large piston sleeve 54*a* having a central passage through which the large piston mandrel 60*a* reciprocates. The large piston sleeve 54*a* also defines a large piston chamber 55*a*. Large piston sleeve ports 58*a*, 58*b* permit contained fluid in the small piston chamber 51*a* on the front side of the small piston 76*a* to enter the large piston chamber 55*a* on the backside of a first large piston 62*a*. A large piston seal 64*a* inhibits any egress of the contained fluid from the backside of the large piston 62*a*. A downhole end of the large piston sleeve 54*a* is connected to a sleeve connector upper thread 42*b* of a sleeve connector 40*b*.

A second small piston sleeve 50*b* is connected to a sleeve connector lower thread 44*b* of the sleeve connector 40*b*. A downhole end of the second small piston sleeve 50*b* is connected to a large piston sleeve thread 56*b* of the second large piston sleeve 54*b*. The second small, piston sleeve 50*b* defines a second small piston chamber 51*b*. Small piston ports 52*c*, 52*d* permit a reciprocation of contained fluid between the energizing fluid chamber 21*b* and the small piston chamber 51*b* on the backside of a second small piston 76*b*. The second small piston 76*b* reciprocates over a second large piston mandrel 60*b* within the small piston chamber 51*b*, as will, be explained below with reference to FIG. 4. The large piston sleeve 54*b* defines a large piston chamber 55*b* in which a second large piston 62*b* reciprocates. A large piston seal 64*b* inhibits contained fluid from escaping the backside of the second large piston 62*b*. Large piston sleeve ports 58*c*, 58*d* permit contained fluid to flow from the small piston chamber 51*b* into the large piston chamber 55*b*, and back again. A downhole end of the large piston sleeve 54*b* is connected to a sleeve connector upper thread 42*c* of a third sleeve connector 40*c*. A third small piston sleeve 50*c* is connected to a sleeve connector lower thread 44*c* of the sleeve connector 40*c*, and a large piston sleeve thread 56*c* of a third large piston sleeve 54*c*. Large piston sleeve ports 58*e*, 58*f* permit contained fluid to reciprocate between the small piston chamber 51*c* and the large piston chamber 55*c* on a backside of a third large piston 62*c*. A large piston seal 64*c* inhibits an escape of contained fluid from the backside of the large piston 62*c*.

The interconnected work string connection sub 12 and bumper mandrel 30 provide an uphole end of a multipart mandrel central passage 61 that extends through the modular force multiplier 10. The interconnected large piston mandrels 60*a*-60*c* provide a downhole end of the multipart mandrel central passage 61. The bumper mandrel chamber 37 provides fluid communication between the uphole end and the downhole end of the multipart central passage when the modular force multiplier 10 is not in the run-in position. Sleeve connector fluid seals 48*a*, 48*b* and 48*c* inhibit any migration of fluid between the multipart mandrel central passage 61 and the contained fluid. Debris management bores 74 assist in the elimination from the bumper mandrel chamber 37 of debris in fluid pumped through the multipart mandrel central passage 61. The large piston mandrel 60*b* is connected to the large piston 62*a* by large piston threads 66*a*. Fluid pressure in the large piston chambers 55*a* and 55*b* is balanced with pumped fluid pressure in the multipart mandrel central passage 61 via large piston pressure equalization bores 68*a* and 68*b* and large piston mandrel pressure equalization bores 72*a* and 72*b*. Large piston mandrel pressure equalization grooves 70*a*, and 70*b* respectively ensure fluid communication between the large piston pressure equalization bores 68*a* and 68*b* and large piston mandrel pressure equalization bores 72*a* and 72*b*.

The modular force multiplier 10 is assembled one module at a time beginning at the downhole end, i.e. the large piston 62*c* is inserted into the large piston sleeve 54*c*. The small piston sleeve 50*c* is then connected to the large piston sleeve 54*c* and the small piston 76 is slid over the large piston mandrel 60*c* until it is just past the small piston ports 52*e* and 52*f*. Small piston fill plugs 84*c* are then removed from the small piston fill bores 82*c* in the small pistons 76*c* and contained fluid is pumped into the small piston chamber 51*c* until it is filled. After the small piston chamber 51*c* is filled the small piston fill plugs 84*c* are replaced, and the sleeve connector 40*c* is connected to the small piston sleeve 50*c*. The large piston 60*b* is then connected to the large piston mandrel 62*c* by large piston threads 66*b*. This process is repeated for each remaining module. Small piston outer seals 78*a*, 78*b* and 78*c* inhibit an egress of fluid around the respective outer sides of small pistons 76*a*, 76*b* and 76*c*. Small piston inner seals 80*a*, 80*b* and 80*c* inhibit an egress of fluid around the respective inner sides of small pistons 76*a*, 76*b* and 76*c*. Small piston fill bores 86*a*, 86*b* and 86*c* permit the small piston chambers 51*a*, 51*b* and 51*c* to be filled with contained fluid, as described above. The respective energizing fluid chambers 21*a*, 21*b* and 21*c* are filled with contained fluid after the force multiplier 10 has been assembled.

As noted above, the bumper mandrel 30 socket end 39 is free to move between the bumper mandrel stop sub 34 and the sleeve connector 40*a*. To accommodate such movement while inhibiting rotation of the multipart energizing sleeve with respect to the work string connection sub 12, anti-rotation studs 96*a*, 96*b* are provided in bores in the work string connection sub 12. Anti-rotation grooves 98*a*, 98*b* permit reciprocal movement of the multipart energizing sleeve 16 within limits defined by a length of travel of the bumper mandrel socket end 39 within the bumper mandrel chamber 37. However, the anti-rotation studs 96*a*, 96*b* and the corresponding anti-rotation grooves 98*a*, 98*b* collectively inhibit any rotation of the multipart energizing sleeve 16 on the work string connection sub 12.

FIG. 3 is a cross-sectional view of the modular force multiplier 10 taken along lines 3-3 shown in FIG. 1. As described above, in the run-in condition the force multiplier 10 is in "neutral" and the force multiple casing function cannot be engaged. This prevents any deployment of any downhole tool(s) connected to the force multiplier 10 while the force multiplier 10 and connected tool(s) are being run into a wellbore. In order to engage the force multiplier function, energizing key mechanisms 88*a*, 88*b* are provided. The energizing key mechanisms 88*a*, 88*b* respectively include an energizing key 92*a*, 92*b*. Each energizing key 92*a*, 92*b* is normally urged to a disengaged position by a pair of energizing key springs 90*a*, 90*b*. An energizing key seal 94*a*, 94*b* inhibits pumped fluid from migrating around the respective energizing keys 92*a*, 92*b*. The respective energizing keys 92*a*, 92*b* are aligned with energizing activation bores 86*a*, 86*b*. As will be explained below with reference to FIG. 4, when pressurized fluid is pumped down the central passage 61 of the modular force multiplier 10, the respective energizing keys 92*a*, 92*b* are driven upwardly against retainer plates 100*a*, 100*b*, and into the energizing activation bores 86*a*, 86*b* after a predetermined pumped fluid pressure is achieved in the modular force multiplier 10. This connects the multipart energizing sleeve 16 to the work string connection sub 12, permitting a pull-up force to be applied to the multipart energizing sleeve 16.

FIG. 4 is a cross-sectional view of the modular force multiplier 10 taken along lines 3-3 shown in FIG. 1, subsequent to the multiplication of a pull-up force applied to a work string connected to the modular force multiplier 10. As will be understood by those skilled in the art, after a downhole tool, connected by large piston threads 66*c* to the modular force multiplier 10, is in a desired location in a wellbore, a mechanism, such as slips, is set to lock the downhole tool into position. The slips may be set mechanically using a J-latch, or hydraulically using pumped down fluid pressure, in a manner well known in the art. After the downhole tool is locked in position and the energizing keys 92*a*, 92*b* are forced into engagement as described above with reference to FIG. 3, a pull-up force is applied at surface to a work string connected to the work string connection sub 12. The pull-up force slides the multipart energizing sleeve 16 uphole with respect to the large piston sleeves 54*a*-54*c*, which are anchored to the downhole tool (not shown). As the multipart energizing sleeve 16 is pulled uphole, captured fluid in the respective energizing fluid chambers 21*a*, 21*b* and 21*c* is forced through the respective small piston ports 52*a*-52*f* and into the respective small piston chambers 51*a*-51*c*. The captured fluid drives the small pistons 76*a*, 76*b* and 76*c* toward the large piston sleeve ports 58*a*-58*f*, which forces the captured fluid into the respective large piston chambers 55*a*, 55*b* and 55*c* urging the large pistons 62*a*, 62*b* and 62*c* downhole with the force, in this embodiment, about 6 times greater than the force of the pull-up force applied to the work string. As will be understood by those skilled in the art, the degree of force multiplication achieved with the modular force multiplier 10 can be readily adjusted by adding or subtracting force multiplier modules. Sliding the multipart energizing sleeve 16 back to the initial run-in position using a push-down force returns the respective small and large pistons to the run-in condition shown in FIG. 1, and any connected tool(s) to an unengaged condition.

The explicit embodiments of the invention described above have been presented by way of example only. The scope of the invention is therefore intended to be limited solely by the scope of the appended claims.

I claim:

1. A force multiplier module, comprising a small piston that reciprocates on a large piston mandrel within a small piston chamber, and a large piston on an end of the large piston mandrel reciprocates within a large piston chamber in response to contained fluid that forces the reciprocation of the small piston, which forces contained fluid in the small piston chamber through large piston ports to urge the reciprocation of the large piston.

2. A force multiplier module, comprising:

a small piston sleeve connected on one end to a sleeve connector, the small piston sleeve having at least one fluid port therethrough adjacent the sleeve connector;

a large piston sleeve connected to an opposite end of the small piston sleeve, the large piston sleeve having at least one fluid port adjacent a central passage therethrough;

a large piston mandrel that extends through the central passage in the large piston sleeve and a central passage in the sleeve connector;

a large piston on an end of the large piston mandrel;

a small piston adapted to reciprocate on the large piston mandrel between the sleeve connector and the large piston sleeve; and an energizing cylinder sleeve that surrounds the sleeve connector and the small piston sleeve and defines an energizing fluid chamber surrounding the small piston sleeve.

3. A modular force multiplier, comprising:

a work string connection sub; and at least one force multiplier module connected to the work string connection sub, the at least one force multiplier module comprising:

a sleeve connector connected to the work string connection sub;

a small piston sleeve connected on one end to the sleeve connector;

a large piston sleeve connected to an opposite end of the small piston sleeve;

a large piston adapted to reciprocate in a large piston chamber of the large piston sleeve, the large piston having a large piston mandrel that extends through central passages in the large piston sleeve and the sleeve, connector;

a small piston adapted to reciprocate on the large piston mandrel between the sleeve connector and the large piston sleeve; and an energizing cylinder sleeve that surrounds the sleeve connector and the small piston sleeve and defines an energizing fluid chamber surrounding the small piston sleeve;

whereby urging the energizing cylinder sleeve to slide over the small piston sleeve forces contained fluid through ports in the small piston sleeve to urge movement of the small piston, which forces contained fluid through ports in the large piston sleeve to urge corresponding movement of the large piston.

4. The modular force multiplier as claimed in claim 3 further comprising a bumper mandrel connected to the work string connection sub, the bumper mandrel having a bumper mandrel socket end.

5. The modular force multiplier as claimed in claim 4 further comprising a bumper mandrel stop sub that reciprocates on the bumper mandrel between the work string connection sub and the bumper mandrel socket end.

6. The modular force multiplier as claimed in claim 5 further comprising a bumper mandrel sleeve connected to the bumper mandrel stop sub, the bumper mandrel sleeve defining a bumper mandrel chamber in which the bumper mandrel socket end reciprocates.

7. The modular force multiplier as claimed in claim 6 wherein a lower end of the bumper mandrel sleeve is connected to an upper sleeve connector thread of the sleeve connector.

8. The modular force multiplier as claimed in claim 3 further comprising an energizing transition sleeve connected to an upper end of the energizing cylinder sleeve.

9. The modular force multiplier as claimed in claim 8 wherein the energizing transition sleeve comprises a fluid sear that inhibits migration of contained fluid between a lower end of the energizing transition sleeve and the small piston sleeve.

10. The modular force multiplier as claimed in claim 9 wherein the sleeve connector comprises a fluid seal that inhibits migration of contained fluid between an upper end of the energizing transition sleeve and the sleeve connector.

11. The modular force multiplier as claimed in claim 10 further comprising an energizing selector sleeve connected to an upper end of the energizing transition sleeve.

12. The modular force multiplier as claimed in claim 11 further comprising anti-rotation grooves in an upper end of the energizing selector sleeve that receive anti-rotation studs in the work string connection sub to inhibit rotation of the energizing selector sleeve on the work string connection sub.

13. The modular force multiplier as claimed in claim 11 further comprising energizing activation bores in the energizing selector sleeve, and energizing key mechanisms in the work string connection sub having energizing keys that are forced into the energizing activation bores when adequate fluid pressure is pumped into a multipart mandrel central passage of the modular force multiplier, to selectively connect the energizing selector sleeve to the work string connection sub.

14. The modular force multiplier as claimed in claim 3 wherein the small piston comprises a small piston inner seal that provides a fluid seal between the small piston and the large piston mandrel, and a small piston outer seal that provides a fluid seal between the small piston and the small piston sleeve.

15. The modular force multiplier as claimed in claim 14, wherein the small piston further comprises small piston fill bores and small piston fill plugs.

16. The modular force multiplier as claimed in claim 3, wherein the large piston comprises a large piston seal that provides a fluid seal between the large piston and an inner surface of the large piston sleeve.

17. The modular force multiplier as claimed in claim 16 wherein the large piston further comprises pressure equalization bores that provide fluid communication with a multipart mandrel central passage of the modular force multiplier.

18. A modular force multiplier, comprising:

a work string connection sub;

a bumper mandrel connected to the work string connection sub, the bumper mandrel having a bumper mandrel socket end;

a bumper mandrel stop sub that reciprocates on the bumper mandrel between the work string connection sub and the bumper mandrel, socket end;

a bumper mandrel sleeve connected to a lower end of the bumper mandrel stop sub, the bumper mandrel sleeve defining a bumper mandrel chamber in which the bumper mandrel socket end reciprocates;

a sleeve connector connected to a lower end of the bumper mandrel sleeve;

a small piston sleeve connected on one end to the sleeve connector;

a large piston sleeve connected to an opposite end of the small piston sleeve;

a large piston adapted to reciprocate in a large piston chamber of the large piston sleeve, the large piston having a large piston mandrel that extends through central passages in the large piston sleeve and the sleeve connector;

a small piston adapted to reciprocate on the large piston mandrel between the sleeve connector and the large piston sleeve;

an energizing selector sleeve that reciprocates on a lower end of the work string connection sub and surrounds the bumper mandrel sleeve;

an energizing transition sleeve connected to a lower end of the energizing selector sleeve and surrounding the sleeve connector and the small piston sleeve, defining an energizing fluid chamber surrounding the small piston sleeve;

whereby urging the energizing selector sleeve to slide the energizing transition sleeve over the small piston sleeve forces contained fluid through ports in the small piston sleeve, to urge movement of the small piston, which forces contained fluid through ports in the large piston sleeve to urge corresponding movement of the large piston.

19. The modular force multiplier as claimed in claim 18, further comprising at least one force multiplier module connected to the large piston sleeve, and the energizing transition sleeve.

20. The modular force multipliers as claimed in claim 19 wherein the force multiplier module comprises:

a second sleeve connector connected to a lower end, of the large piston sleeve;

a second small piston sleeve connected to a lower end to the second sleeve connector, the second small piston sleeve having at least one fluid port therethrough adjacent the second sleeve connector;

a second large piston sleeve connected to an opposite end of the second small piston sleeve, the second large piston sleeve having at least one fluid port adjacent a central passage;

a second large piston mandrel that extends through the central passage in the second large piston sleeve and a central passage in the second sleeve connector;

a second large piston on the second large piston mandrel;

a second small piston adapted to reciprocate on the second large piston mandrel between the second sleeve connector and the second large piston sleeve; and an energizing cylinder sleeve that surrounds the second sleeve connector and the second small piston sleeve and defines a second energizing fluid chamber surrounding the second small piston sleeve.

* * * * *